US009493993B1

(12) United States Patent
Dallas et al.

(10) Patent No.: US 9,493,993 B1
(45) Date of Patent: Nov. 15, 2016

(54) WORK STRING AND METHOD OF COMPLETING LONG LATERAL WELL BORES

(71) Applicant: PTECH Drilling Tubulars LLC, Conroe, TX (US)

(72) Inventors: Lloyd Murray Dallas, Streetman, TX (US); Nels Peter Wickander, Conroe, TX (US)

(73) Assignee: PTECH DRILLING TUBULARS LLC, Conroe, TX (US)

( * ) Notice: Subject to any disclaimer, the term of this patent is extended or adjusted under 35 U.S.C. 154(b) by 0 days.

(21) Appl. No.: 14/735,846

(22) Filed: Jun. 10, 2015

(51) Int. Cl.

| | |
|---|---|
| ***E21B 17/00*** | (2006.01) |
| ***E21B 17/04*** | (2006.01) |
| ***E21B 7/04*** | (2006.01) |
| ***E21B 43/16*** | (2006.01) |

(52) U.S. Cl.
CPC ..... *E21B 17/04* (2013.01); *E21B 7/046* (2013.01); *E21B 17/00* (2013.01); *E21B 43/16* (2013.01)

(58) Field of Classification Search
CPC ..... E21B 17/00; E21B 17/04; E21B 7/046
See application file for complete search history.

(56) References Cited

U.S. PATENT DOCUMENTS

| | | | | |
|---|---|---|---|---|
| 4,811,800 | A | 3/1989 | Hill et al. | |
| 4,987,961 | A * | 1/1991 | McNeely, Jr. | E21B 7/04 138/109 |
| 5,148,876 | A * | 9/1992 | Wilson | E21B 7/04 175/325.3 |
| 5,379,625 | A | 1/1995 | Hale | |
| 5,743,301 | A | 4/1998 | Winship | |
| 5,853,199 | A | 12/1998 | Wilson | |
| 5,908,212 | A | 6/1999 | Smith et al. | |
| 6,012,744 | A | 1/2000 | Wilson et al. | |
| 8,539,807 | B2 | 9/2013 | Dial et al. | |
| 8,915,310 | B2 | 12/2014 | Flusche | |
| 2006/0245469 | A1 * | 11/2006 | Koeniger | E21B 33/035 374/208 |
| 2011/0012347 | A1 | 1/2011 | Pacheco | |
| 2014/0333065 | A1 | 11/2014 | Pacheco | |
| 2016/0053546 | A1 * | 2/2016 | Samuel | E21B 28/00 175/40 |

OTHER PUBLICATIONS

Workstring International "Specification Sheet 2 7/8" P-110, 8.70 LBS/FT, PH6/TS6 Tubing", Apr. 18, 2011; US.
Workstring International "Specification Sheet 2 3/8" AC95, 7.70 LBS/FT, PH6 Tubing", Apr. 18, 2011; US.

* cited by examiner

*Primary Examiner* — Matthew R Buck
*Assistant Examiner* — Aaron Lembo
(74) *Attorney, Agent, or Firm* — J. Bennett Mullinax, LLC

(57) ABSTRACT

A work string for completing long lateral well bores is assembled using small diameter drill pipe having a nigh make-up torque for a curved section and lateral bore of a well. A larger diameter drill pipe is used in the vertical section of the well to facilitate pushing the small diameter drill pipe through the long lateral bore.

10 Claims, 8 Drawing Sheets

WORK STRING AND METHOD OF COMPLETING LONG LATERAL WELL BORES

FIELD OF THE INVENTION

This invention relates in general to well bore completion and, in particular, to a novel work string and a method of completing long lateral well bores.

BACKGROUND OF THE INVENTION

When a well is drilled, production casing is set so that the well is properly cemented and the production zones do not have communication. The production zone is logged and then perforated so that flow of oil or gas can be drained from the oil or gas bearing zone into a production casing of the well. Traditionally, hydrocarbon wells were drilled vertically down to and through one or more production zone(s). Over the last decade horizontal drilling techniques have evolved. Wells are now drilled vertically to a point just above the production zone and then curved so that the well bore enters the production zone at an angle and continues laterally within the production zone for more in-zone exposure to the formation. Some production zones are up to 300 feet (91.5 meters) thick and with horizontal drilling techniques casing can be run up to 10.000 ft. (3 kilometers) into the production zone, thus providing significantly more drainage area into the production casing. Horizontal drilling also enables the drilling of multiple horizontal bores in different directions from a pad of 2 or more wells. This speeds up drilling and uses less footprint to drain the production zone(s). It also permits drilling under lakes, cities and property that would create hardship for land owners if drilling had to be performed in the traditional manner.

FIG. 1 is a schematic cross-sectional diagram of an exemplary prior art long lateral well bore 10. Well know features such as the conductor and surface casing are not shown. A vertical section 12 of the well bore 10 is drilled vertically into proximity of a production zone 14, cased and cemented in a manner well known in the art. In many areas, the vertical section of the well may be up to 10,000 feet (3 kilometers) in length. A curved section 16 of the well bore is then drilled into the production zone 14. Once it is established that the curved section is in the production zone 14, a lateral bore 18 is drilled in a desired direction in as straight a path as possible within the production zone. As is well understood in the art, the horizontal bore 18 is generally somewhat corkscrew shaped due to remote control of the drill motor. If the lateral bore is very long, a first section having a length of $HL_1$ (5,000 feet or more, for example) may be drilled for 5.5" casing and a second section 22 having a length of $HL_2$ (3,000-5,000 feet or more) may be drilled for 4.5" casing. However, this is exemplary only and not required. The curved section and the lateral bore are then cased and cemented. If the horizontal bore requires two different casing sizes, a casing transition sub 20 is used to connect the 5.5" casing to the 4.5" casing.

Conventional tubing has been successfully used for years as a work string for completing vertical and horizontal bores. Those skilled in the art understand that work strings are used to perform many completion functions including setting packers or plugs 24 at predetermined intervals for the purpose of fracture treating the production zone 14. Chemical treatments 26, such as acids or other production aids may also be injected into the well using a tubing work string. As described above, when well bores with long laterals are drilled there is generally considerable deviation in the lateral bore due to remote steering of the drill motor. Since the work string has to wind through those deviations for completion purposes, more torque is required to turn the string to perform many desired completion functions. As a result, attempts to complete lateral bores that exceed 5,000 feet (1.5 kilometers) using tubing work strings is fraught with problems because the tubing buckles or shears. Such problems cause delays and increase well completion expense.

There therefore exists a need for a novel work string and a method of completing long lateral well bores.

SUMMARY OF THE INVENTION

It is therefore an object of the invention to provide a novel work string and a method of completing long lateral well bores.

The invention therefore provides a work string used to complete a well bore having a long lateral bore, comprising: a first drill pipe string having a nominal outer diameter of 2.375 inches and a minimum makeup torque of 5,000 foot-pounds for use in a curved and horizontal section of the well bore; a second drill pipe string for use in at least a portion of a vertical section of the well bore, the second drill pipe string having nominal outer diameter of 2.875 inches and including at least one joint of heavy-weight drill pipe having a minimum adjusted weight of 13 pounds per foot; the second drill pipe string having a minimum makeup torque of 7,500 foot-pounds; and a cross-over sub for connecting the first drill pipe string to the second drill pipe string.

The invention further provides a work string used to complete a well bore having a long lateral bore, comprising: a first drill pipe string having a nominal outer diameter of 2.375 inches and a minimum makeup torque of 5,000 foot-pounds for use in a curved and horizontal section of the well bore; a second drill pipe string for use in at least a portion of a vertical section of the well bore, the second drill pipe string having nominal outer diameter of 2.875 inches and including at least one joint of heavy-weight drill pipe having a minimum adjusted weight of 13 pounds per foot; the second drill pipe string having a minimum makeup torque of 7,500 foot-pounds; and a cross-over sub for connecting the first drill pipe string to the second drill pipe string.

The invention yet further provides a method of completing a cased well bore with a curved section and a long lateral bore, comprising: running a work string of high torque drill pipe joints into the well until a length of the work string of high torque drill pipe joints equals at least a combined length of the curved section plus a length of the long lateral bore, the string of high torque drill pipe joints having a maximum nominal outer diameter of 2.375 inches, a maximum adjusted weight of 7.7 pounds per foot, and a minimum makeup torque of 5,000 foot-pounds; connecting a cross-over sub to the string of high torque drill pipe; adding larger diameter high torque drill pipe joints to the work string until the work string resists further movement into the long lateral well bore, the larger diameter high torque drill pipe joints having a maximum nominal outer diameter of 2.875 inches, a maximum adjusted weight of 12 pounds per foot, and a minimum makeup torque of 7,500 foot-pounds; and adding at least one of a heavy-weight drill pipe joint and a drill collar to the work string until the work string is pushed to an end of the lateral bore, the heavy-weight drill pipe joints having a maximum nominal outer diameter of 2.875 inches and a minimum adjusted weight of 13 pounds per foot, and the drill collar joints having a same connection diameter as a connection diameter of the larger diameter drill pipe joints and a minimum adjusted weight of 23 pounds per foot.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a work string used to complete a long lateral well bore and a method of completing long lateral well bores using a slim hole drill pipe work string. The work string includes at least a drill pipe string with a nominal outer diameter of 2.375 inches and a minimum makeup torque of 5,000 foot-pounds for use in a curved and lateral section of the well bore. A second larger diameter drill pipe string is used in a vertical section of the well bore. The second larger diameter drill pipe joints having a nominal outer diameter of 2.875 inches and a minimum makeup torque of 7,500 foot-pounds. Heavy weight drill pipe joints are added to the second drill pipe string as required to push the work string into the well bore. The heavy weight drill pipe joints have a minimum adjusted weight of 13 pounds per foot and a minimum makeup torque of 7,500 foot-pounds. Drill core joints may also be added to the second larger diameter drill pipe string for additional weight for pushing the work string through the horizontal bore, the drill core joints having a minimum adjusted weight of 23 pounds per foot and a minimum makeup torque of 7,500 foot-pounds. A cross-over sub connects the first drill pipe string to the second larger diameter drill pipe string.

Figure 2:
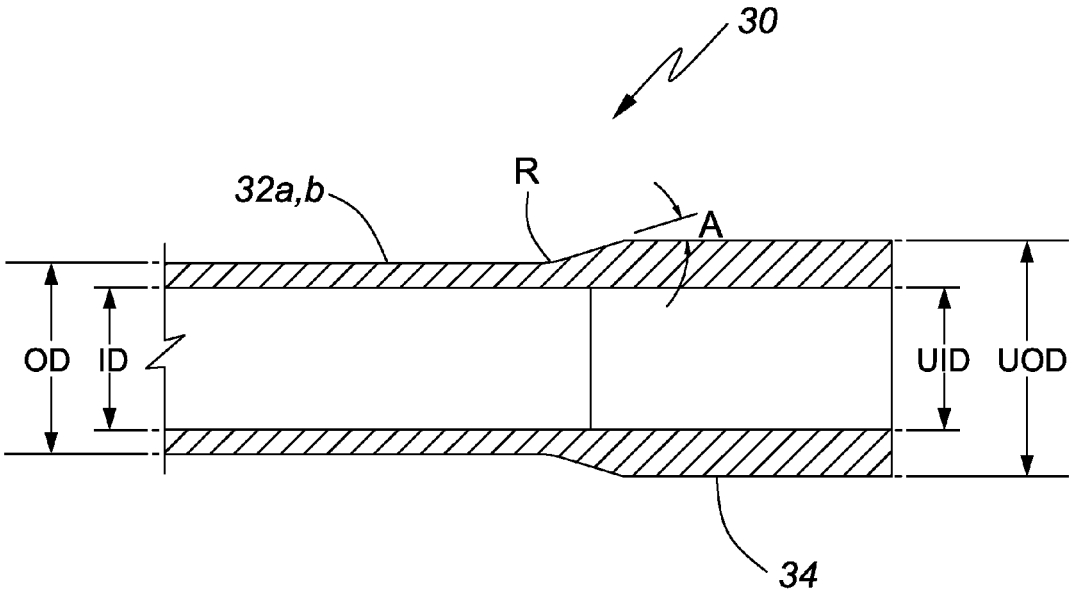
FIG. 2 is a schematic cross-sectional diagram of an upset pipe end in accordance with the invention.

FIG. 2 is a schematic cross-sectional diagram of an upset drill pipe end 30 in accordance with the invention. A drill pipe 32*a,b* has a nominal outer diameter (OD) of 2.375" in a first embodiment 32*a* and a nominal OD of 2.875" in a second embodiment 32*b*. The drill pipe 32*a,b* has a nominal inner diameter (ID) of 1.815" in the first embodiment 32*a* and a nominal ID of 2.151" in the second embodiment 32*b*. An upset 34 is forged on each end of the drill pipe 32*a,b* in a manner known in the art. The upset 34 has a nominal outer diameter (UOD) of 3.062" in the first embodiment 32*a* and a nominal UOD of 3.625" in the second embodiment 32*b*. The upset 34 also has a nominal inner diameter (UID) of 1.5" in the first embodiment 32*a* and a nominal UID of 2.0" in the second embodiment 32*b*. A transition curve from the drill pipe 32*a,b* to the forged upset 34 has a nominal radius (R) of 1.5" and a nominal angle of inclination (A) of 18°.

Figure 3:
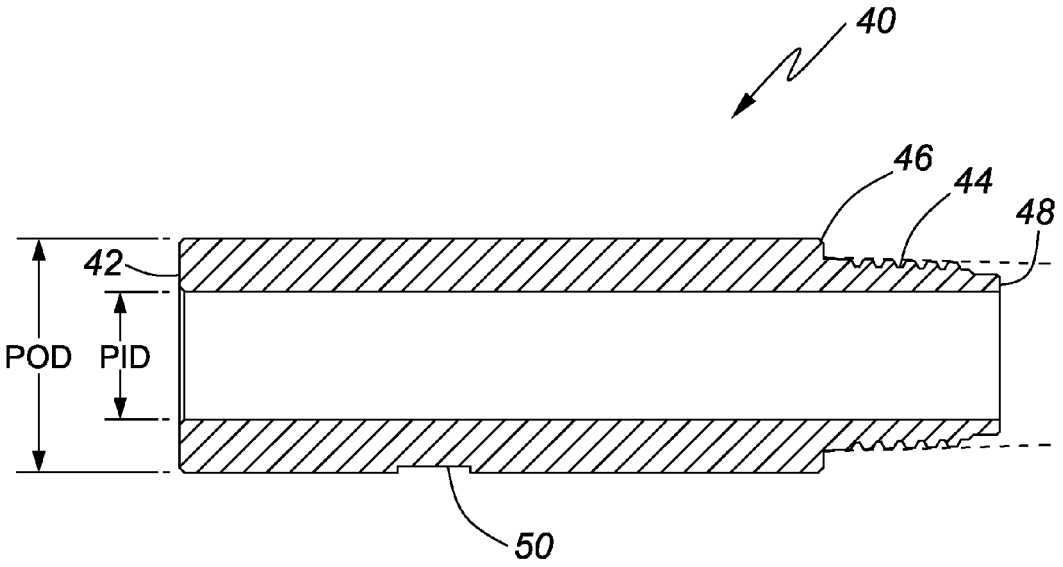
FIG. 3 is a schematic-cross sectional diagram of a pin end pipe joint connection that is friction welded to the upset pipe end shown in FIG. 2.

FIG. 3 is a schematic-cross sectional diagram of a pin end pipe joint connection 40 that is friction welded to the upset drill pipe end 30 shown in FIG. 2. The pin end connection 40 has an outer diameter (POD) of 3.062" in the first embodiment and 3.625" in the second embodiment, and an inner diameter (PID) of 1.5" in the first embodiment and 2.0" in the second embodiment. Thus the UOD and UID of the pipe upset 30 matches the POD and PID of the pin end connection 40. This ensures maximum friction weld area between the upset end 30 of the drill pipe 32*a,b* and the pin end connection 40, which provides a weld joint that can withstand extreme torsion and tensile stresses. The outer end of the pin end connection 40 is provided with a male or pin thread 44. The pin thread 44 is an adaptation of the threaded tool joint connection described in United States published patent application 2011/0012347A1 published on Jan. 20, 2011, the specification of which is incorporated herein by reference. The thread pitch and thread length of the pin thread 44 have been reengineered to the smaller diameters of the first and second embodiments of the pin end connections 40. A primary shoulder 46 and a secondary shoulder 48 provide torque resistance as will be explained below with reference to FIG. 4. A milled slot 50 accommodates stamped pipe grade and a pipe weight codes.

Figure 4:
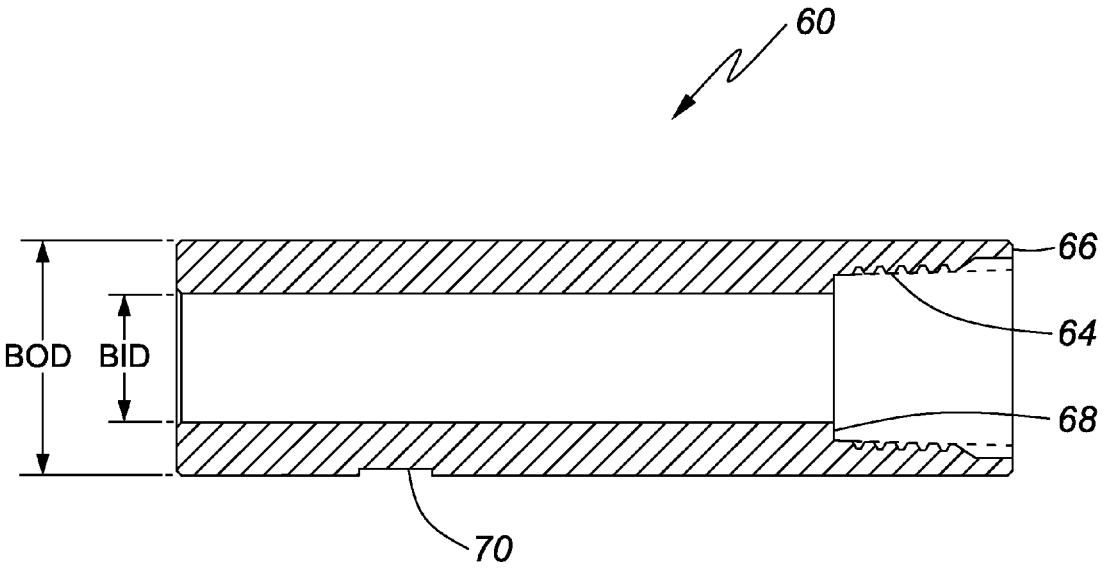
FIG. 4 is a schematic-cross sectional diagram of box end pipe joint connection that is friction welded to the upset pipe end shown in FIG. 2.

FIG. 4 is a schematic-cross sectional diagram of box end pipe joint connection 60 that is friction welded to the upset pipe end 30 shown in FIG. 2. The box end connection 60 has an outer diameter (BOD) of 3.062" in the first embodiment and 3.625" in the second embodiment, and an inner diameter (BID) of 1.5" in the first embodiment and 2.0" in the second embodiment. Thus the UOD and UID of the pipe upset 30 matches the BOD and BID of the box end connection 60. This ensures maximum friction weld area between the upset end of the drill pipe 30 and the box end connection 60, which provides a weld joint that can withstand extreme torsion and tensile stresses. The outer end of the box end connection 60 is provided with a female or box thread 64. The box thread 64 is an adaptation of the threaded tool joint connection described in the above-referenced published United States patent application. The thread pitch and thread length have been reengineered to the smaller diameters of the first and second embodiments of the box end connections 60. A primary shoulder 66 and a secondary shoulder 68 cooperate with the respective primary shoulder 46 and the secondary shoulder 48 to provide extreme torque resistance in a manner explained in the above-referenced published patent application. A milled slot 70 accommodates stamped pipe grade and a pipe weight codes.

Although the drill pipes 32*a* and 32*b* have been described with reference to the tool joint connection described in United States published patent application 2011/0012347A1, it should be noted that any known high torque, double shouldered drill pipe thread can be used for the same purpose.

The characteristics of the first embodiment 32*a* and second embodiment 32*b* of the drill pipe used for work strings in accordance with invention are set out in the table below. All characteristics are for new 95% RBW (remaining body wall) pipe.

| | | |
|---|---|---|
| OUTSIDE DIAMETER (OD) | 2.375" | 2.875" |
| Wall Thickness | 0.301" | 0.389" |
| Inside Diameter (ID) | 1.773" | 2.097" |
| Calculated Plain End Weights (lbs/ft) | 6.664 | 10.327 |
| Adjusted Weight (lbs/ft) | 7.63 | 11.51 |
| Cross sectional area pipe body | 1.961" | 3.039" |
| Cross section area OD | 4.430" | 6.492" |
| Cross sectional area ID | 2.469" | 3.453" |
| Section modulus ($in^3$) | 0.907 | 1.673 |
| Polar section modulus ($in^3$) | 1.813 | 3.346 |
| Torsional Strength (ft-lbs) | 11,800 | 21,700 |
| tensile Strength (lbs) | 264,800 | 410,300 |
| Pressure Capacity (psi) | 29,942 | 31,978 |
| Collapse Capacity (psi) | 29,882 | 31,599 |
| Connection OD | 3.062" | 3.625" |
| Connection ID | 1.5" | 2.0" |
| Pin Tong Length | 10" | 10" |
| Box Tong Length | 13" | 13" |
| Torsional Strength (ft-lbs) | 9,610 | 14,460 |
| Recommendec Make-Up Torque (ft-lbs) | 5,800 | 8,700 |
| Min. Recommended Make-Up (ft-lbs) | 5,200 | 7,800 |
| Balance OD | 3.041" | 3.602" |
| Tensile Strength (lbs) | 269.700 | 352,600 |

Figure 5:
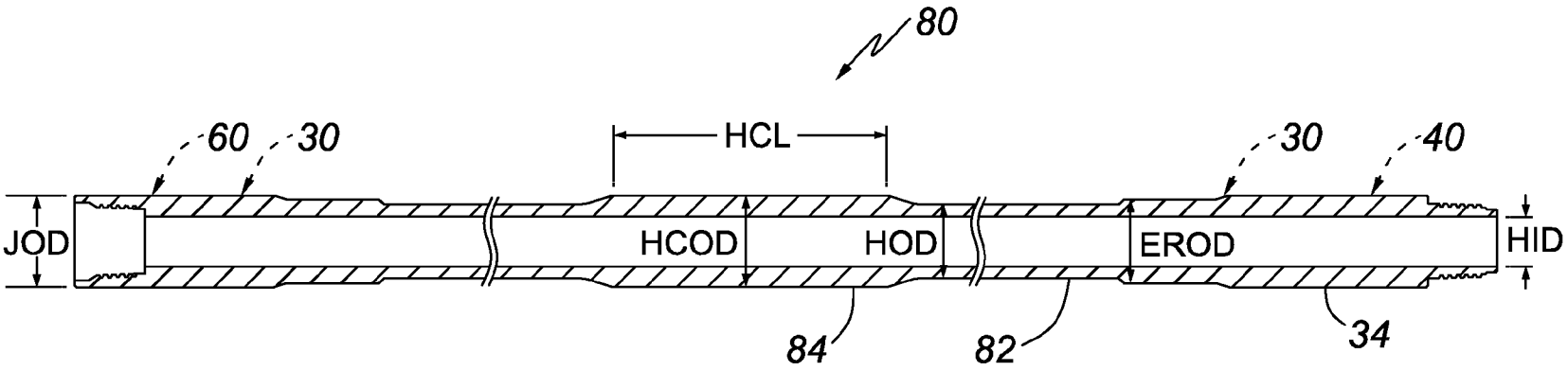
FIG. 5 is a schematic cross-sectional diagram of a heavy-weight drill pipe joint used in a completion string in accordance with the invention.

FIG. 5 is a schematic cross-sectional diagram of a heavy-weight drill pipe (HWDP) 80 used in the completion string in accordance with the invention. The HWDP 80 is designed to have the same stiffness as the connection described above, while providing extra weight to facilitate pushing very long work strings. In one embodiment, the HWDP 80 is machined from solid tubular stock. Alternatively, the HWDP 80 may have a pin connection 40 that is friction welded to the pipe upset 30 as described above, and a box connection 60 that is friction welded to the pipe upset 30. The connections 40, 60 have the same outer diameter (JOD) as the regular drill pipe, i.e. 3.062" in the first embodiment and 3.625" in the second embodiment and the same inner diameter (HID), i.e. 1.5" in the first embodiment 32*a* and 2.0" in the second embodiment 32*b*. An elevator recesses 82 has a maximum outer diameter (EROD) of 2.653" in the first embodiment and 3.188" in the second embodiment to conform to the maximum elevator diameter specified in API 7-1 for HWDP. The HWPD 80 has an outer diameter (HOD) of 2.375" in the first embodiment and 2.875" in the second embodiment. In the center of the HWDP 80 is a large diameter center section 84 that contributes weight to the pipe. The large diameter center section 84 has a length (HCL) of 24" in one embodiment, though that is a design feature and not a requirement. The large diameter center section 84 has an outer diameter (HCOD) of 2.875" in the first embodiment and 3.375" in the second embodiment.

Figure 6:
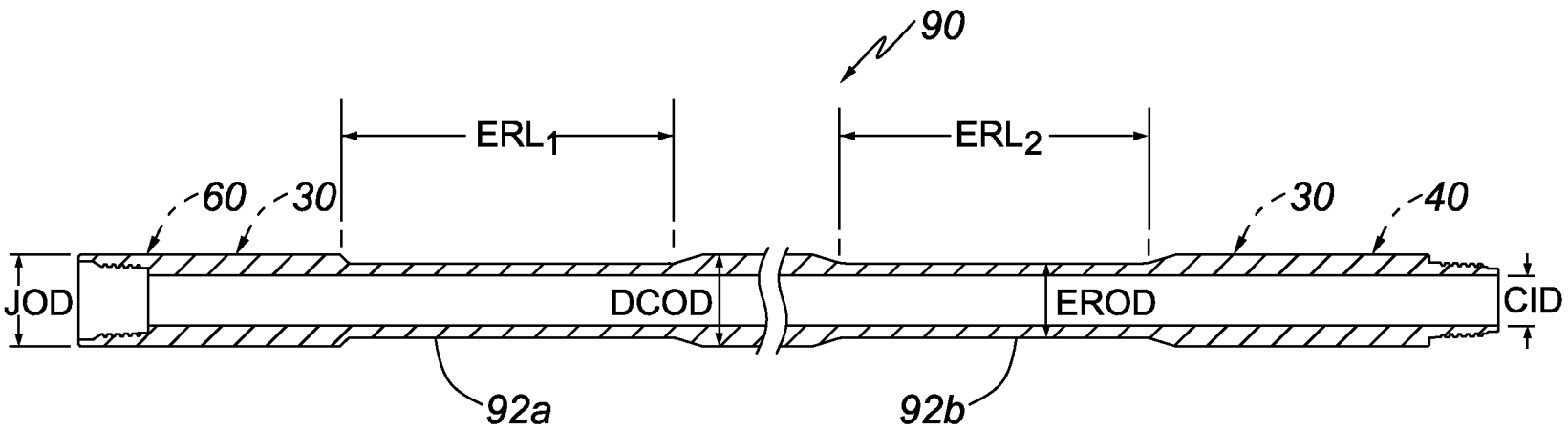
FIG. 6 is a schematic cross-sectional diagram of a drill collar used in a completion string in accordance with the invention.

FIG. 6 is a schematic cross-sectional diagram of a drill collar (DC) 90 used in a completion string in accordance with the invention. The DC 90 does not have the same flex as the regular drill pipe or the HWDP 80 described above, and is used only in the vertical section of the well to provide extra weight to facilitate pushing very long work strings. In one embodiment the DC 90 is machined from solid tubular stock. Alternatively, the DC 90 may have a pin connection 40 that is friction welded to the pipe upset 30 as described above, and a box connection 60 that is friction welded to the pipe upset 30. The connections 40, 60 have the same outer diameter (JOD) as the regular drill pipe i.e. 3.062" in the first embodiment and 3.625" in the second embodiment; and the same inner diameter (CID), i.e. 1.5" in the first embodiment and 2.0" in the second embodiment. Elevator recesses 92*a*, 92*b* have a maximum outer diameter (EROD) of 3.0" and a length ($ERL_1$, $ERL_2$) of about 24". Between the elevator recess 92*a*, 92*b* the DC 90 has an outer diameter (DCOD) of 3.062" in the first embodiment and 3.625" in the second embodiment.

Weight properties of the HDWP 80 and the DC 90 are detailed in the table below:

| TYPE | DIAMETER | JOINT WEIGHT | ADJUSTED WEIGHT (LB-FT) |
|---|---|---|---|
| HWDP | 2.375" | 325 | 10.31 |
| HWDP | 2.875" | 422 | 13.39 |
| DC | 2.375" | 572 | 18.15 |
| DC | 2.875" | 739 | 23.45 |

Figure 7:
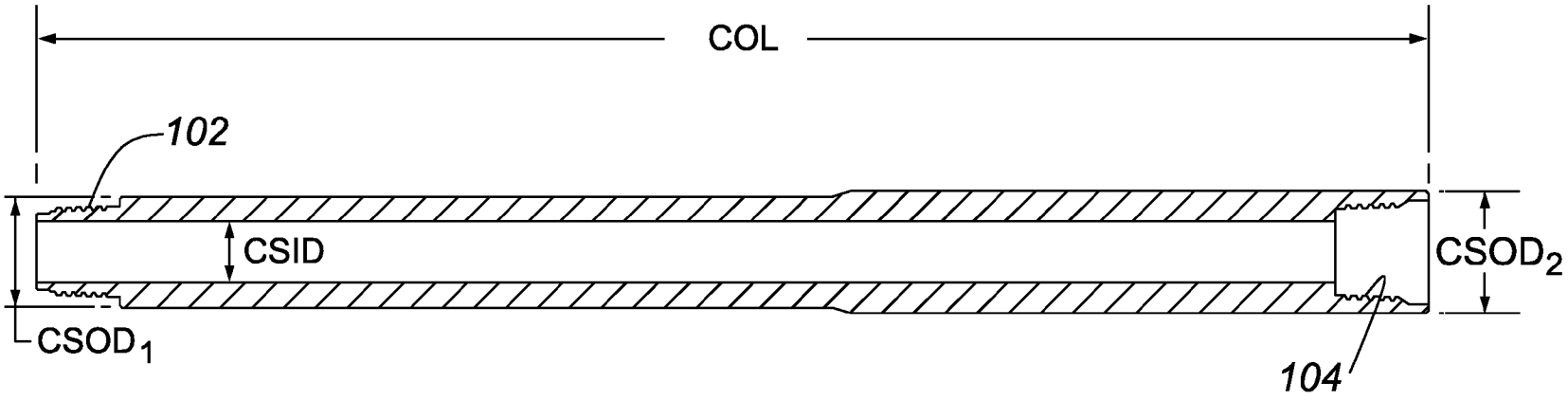
FIG. 7 is a schematic cross-sectional diagram of a cross-over sub used to connect drill pipe strings of different diameters to make up a work string in accordance with the invention.

FIG. 7 is a schematic cross-sectional diagram of a cross-over sub 100 used to connect drill pipe strings of the first embodiment 32*a* and second embodiment 32*b*, HWDP 80 and/or DC 90 to make up a work string in accordance with the invention. The cross-over sub 100 is forged from a single piece of AISI 4130M7 or equivalent. The cross-over sub 100 has an inner diameter of 1.5" to match the inner diameter of the first embodiment 32*a* of the drill pipe described above. A pin connection 102 of the cross-over sub 100 has an outer diameter ($CSOD_1$) of 3.062". A box connection 104 of the cross-over sub 100 has an outer diameter ($CSOD_2$) of 3.625". An overall length of the cross-over sub 100 is 38.75", though this is a matter of design choice.

Figure 1:
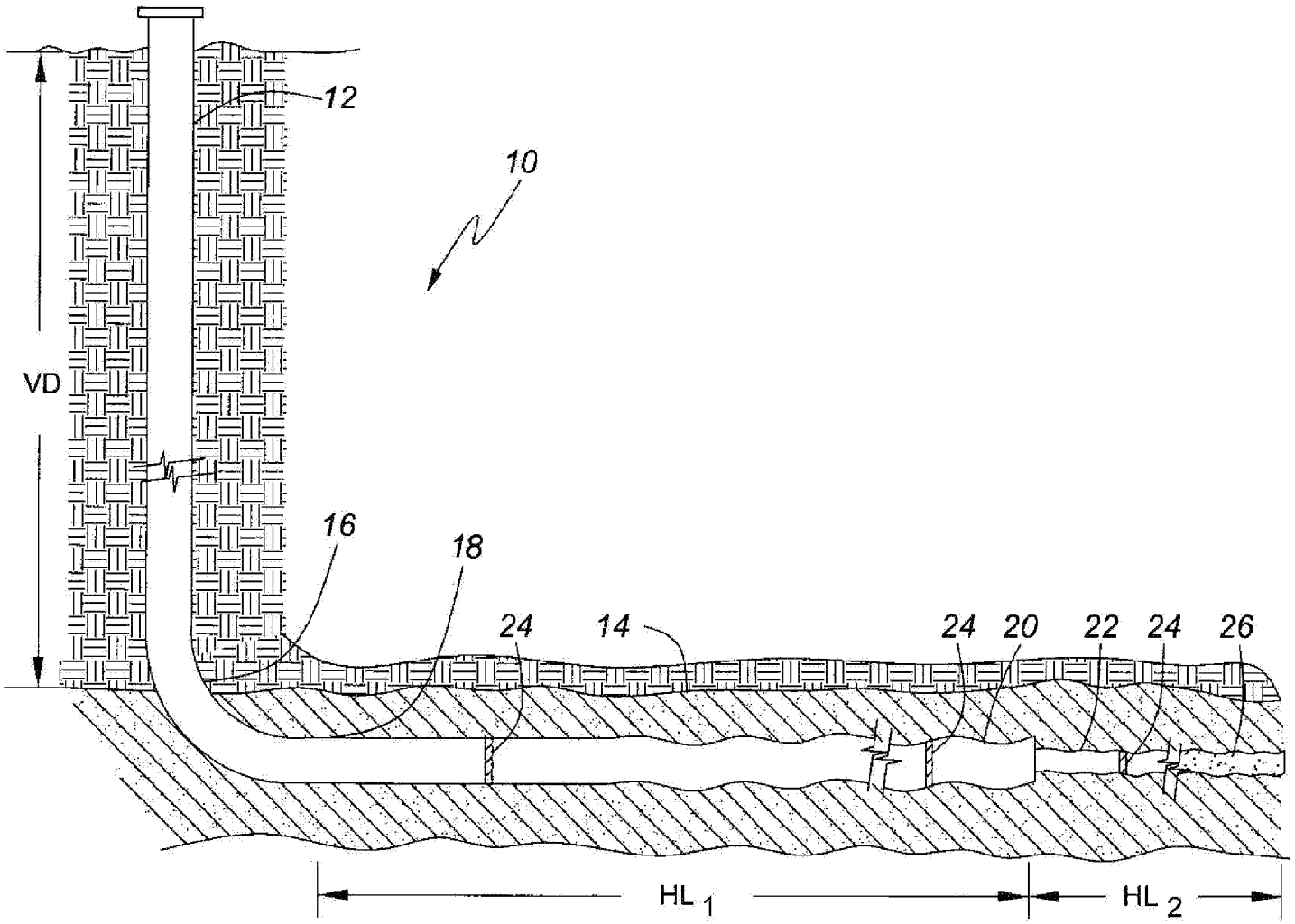
(PRIOR ART) FIG. 1
FIG. 1 is a schematic cross-sectional diagram of an exemplary prior art long lateral well bore.
Figure 8:
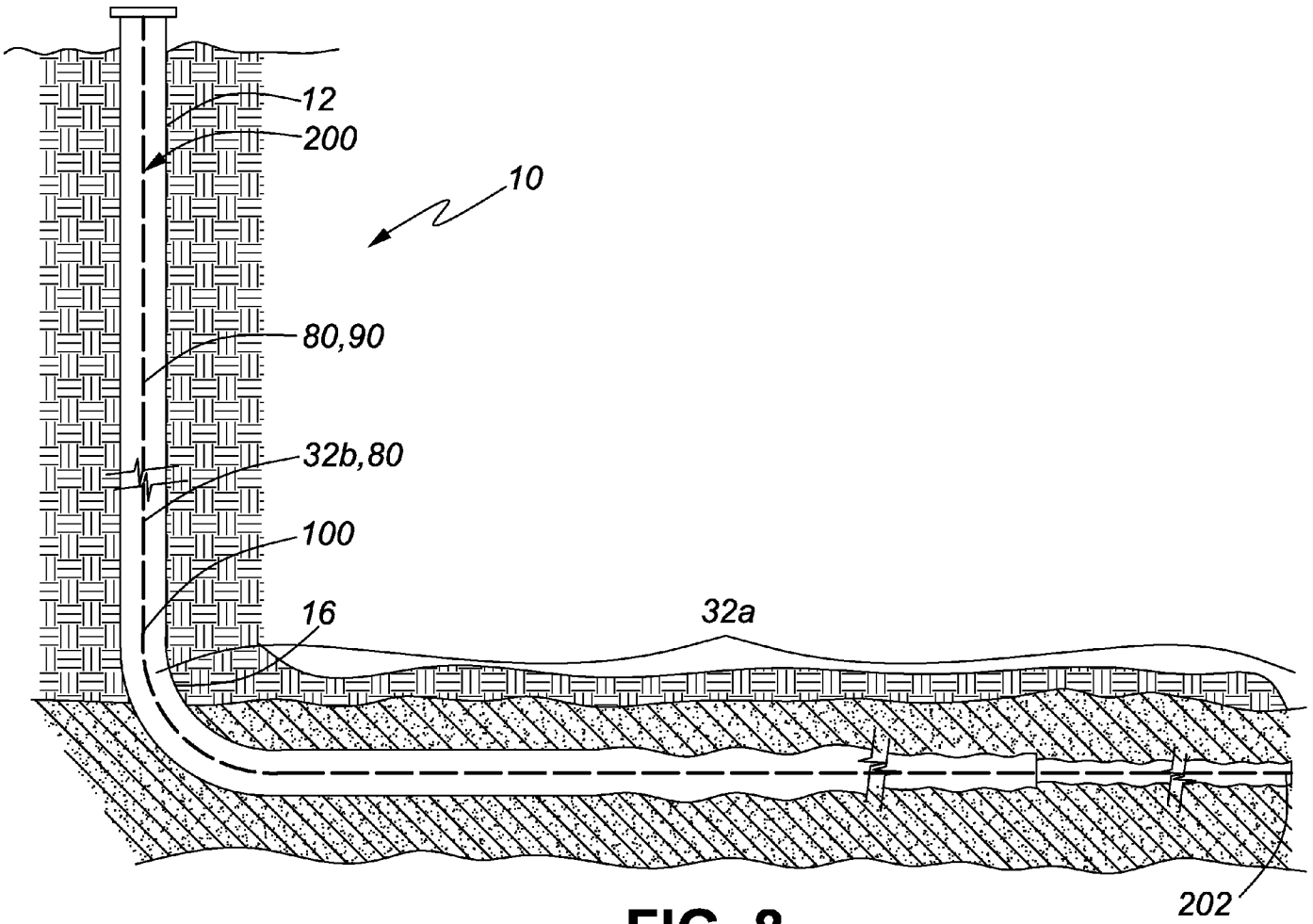
FIG. 8 is a schematic cross-sectional diagram of the work string in accordance with the invention run into the exemplary long lateral well bore shown in FIG. 1.

FIG. 8 is a schematic cross-sectional diagram of a work string 200 in accordance with the invention run into the exemplary long lateral cased well bore 10 shown in FIG. 1. The cased well bore 10 has a vertical bore of 10,000' and a lateral bore 18 that exceeds 5,000'. In accordance with the invention, a work string 200 is run into the well using drill pipe elevators (not shown), which reduces pipe handling time and is more convenient than running in a tubing work string using a tubing lifting sub. In accordance with the invention, a string of drill pipe 32*a* (2.375" nominal outer diameter) is run into the well until that string is as long as the lateral bore 18 and the curved section 16. The small diameter of the drill pipe 32*a* facilitates insertion into the lateral bore 18, promotes evacuation of debris, reduces rotational drag and is therefore easier to push through the lateral bore 18. If there are packers or plugs to be drilled out of the lateral bore 18, a drill bit 202 is either mounted directly to the first joint of drill pipe 32*a* or mounted to a mud motor that is mounted to the first joint of drill pipe 32*a* before it is fed into the well bore 10. Since the drill pipe 32*a* is robust and capable of high torque, it can be used to drill out packers or plugs using any one of many types of drill bits and a top drive to rotate the work string 200. If a mud motor is used, the mud motor may stall due to pressure loss at the end of a very long tubing string. However, the work string 200 is robust enough to rotate the mud motor and the drill bit so that drilling may continue. Once the string length of drill pipe 32*a* run into the well matches the length of the curved section 16 plus the lateral bore 18 (5,000'-10,000' or more), the cross-over sub 100 is connected to the top of the work string 200 and joints of drill pipe 32*b* are added until it becomes apparent that more work string weight is required to push the work string 200 into the well bore 10. In accordance with the invention, HWDP 80 or DC 90 are added to the work string as required to achieve the desired work string weight. HWDP and DC 90 are intermixed with drill pipe 32*b* as desired. The larger inner diameter of drill pipe 32*b*, HWDP 80 and DC 90 reduces fluid friction in the vertical section of the work string 200 to facilitate fluid flow through the work string 200.

It should be noted that any one of many configurations of drill bit can be mounted to the end of the work string 200, because the work string 200 has the torsion strength required to drill in longer laterals even when deviation in a long lateral induces considerable rotational drag. Since the work string 200 does not require a mud motor for drilling, an operator can perform several functions without tripping the work string 200. Complete wellbore cleanout may be achieved and the well acidized or treated with other chemicals before the work string 200 is pulled from the well.

It should be further noted that the work string 200 can be used to perform any downhole job including: snubbing; cementing; casing repairs; drilling or milling out anything dropped or stuck in a well such as plugs, packers, sliding sleeves or nipples; acidizing; spotting chemicals; abrasive jetting; setting sleeves; removing sleeves and clean outs; opening or closing sliding sleeves; tubing conveyed perforating; side tracking a new lateral by cutting casing and drilling the new lateral; extension of existing lateral bores; well depth extension; under-balanced completions; under-balanced drilling; casing repair, such as setting liners; and, fishing are just some of the uses an operator may consider for the use of the work string 200. A large selection of fishing tools can be connected to the work string 200, such as grapples and over-shots, so that items stuck or dropped into the well bore can be retrieved using the very high torsion and tensile strength of the work string 200 to pull the stuck equipment free and to bring the stuck equipment to surface. The extra tensile and torsion strength of the work string 200 permits an operator to use hydraulic assisted pulling devices at surface or jars down hole to loosen stuck equipment.

The invention has been described with specific reference to a specific type of slim hole drill pipe by way of example only. The scope of the invention is therefore intended to be limited solely by the scope of the appended claims.

We claim:

1. A work string used to complete a cased well bore having a long lateral bore, comprising:

a first drill pipe string for use in a curved and horizontal section of the cased well bore, the first drill pipe string having a nominal outer diameter of 2.375 inches, a nominal pipe body wall thickness of 0.301", an upset forged on each end of the first drill pipe having a nominal outer diameter of 3.062" and a nominal inner diameter of 1.5", and calculated plain end weight of 6.664 lbs/ft, a connection friction welded to each upset, each connection having a connection outer diameter of 3.062", connection inner diameter of 1.5", a connection torsional strength of at least 9,600 ft/lbs and a connection tensile strength of at least 269,000 lbs, and a minimum makeup torque of 5,000 foot-pounds;

a second drill pipe string for use in at least a portion of a vertical section of the cased well bore, each joint of the second drill pipe string having nominal outer diameter of 2.875 inches, a nominal pipe body wall thickness of 0.389 inches, an upset forged on each end of the joints of the second drill pipe string having a nominal outer diameter of 3.625 inches and a nominal inner diameter of 2.0 inches, and calculated plain end weight of 10.327 pounds per foot, a connection friction welded to each upset, each connection having a connection outer diameter of 3.625 inches, connection inner diameter of 2.0 inches, a connection torsional strength of at least 14,400 foot-pounds and a connection tensile strength of at least 352,000 pounds, and the second drill pipe string further including at least one joint of heavy-weight drill pipe having a minimum adjusted weight of 13 pounds per foot; each joint of the second drill pipe string having a minimum makeup torque of 7,500 foot-pounds; and a cross-over sub for connecting the first drill pipe string to the second drill pipe string.

2. The work string as claimed in claim 1 wherein the second drill pipe string comprises at least one drill collar having a connection diameter of a same size as the connection diameter of joints in the second drill pipe string and minimum adjusted weight of 23 pounds per foot.

3. The work string as claimed in claim 1 wherein drill pipe joints of the first drill pipe string have a an adjusted weight of 7.63 pounds per foot.

4. A work string used to complete a cased well bore having a long lateral bore, comprising:

a first drill pipe string for use in a curved and horizontal section of the cased well bore, the first drill pipe string having a nominal outer diameter of 2.375 inches, a nominal pipe body wall thickness of 0.389 inches, an upset forged on each end of the first drill pipe having a nominal outer diameter of 3.625 inches and a nominal inner diameter of 2.0 inches, and calculated plain end weight of 10.327 pounds per foot, a connection friction welded to each upset, each connection having a connection outer diameter of 3.625 inches, connection inner diameter of 2.0 inches, a connection torsional strength of at least 14,400 foot-pounds and a connection tensile strength of at least 352,000 pounds, and a minimum makeup torque of 5,000 foot-pounds;

a second drill pipe string for use in at least a portion of a vertical section of the cased well bore, joints of the second drill pipe string having nominal outer diameter of 2.875 inches, a nominal pipe body wall thickness of 0.389 inches, an upset forged on each end of each joint of the second drill pipe string having a nominal outer diameter of 3.625 inches and a nominal inner diameter of 2.0 inches, and calculated plain end weight of 10.327 pounds per foot, a connection friction welded to each upset, each connection having a connection outer diameter of 3.625 inches, connection inner diameter of 2.0 inches, a connection torsional strength of at least 14,400 foot-pounds and a connection tensile strength of at least 352,000 pounds, and including at least one joint of drill collar having a connection diameter of a same size as the connection diameter of joints in the second drill pipe string and minimum adjusted weight of 23 pounds per foot; each drill collar and each joint of the second drill pipe string having a minimum makeup torque of 7,500 foot-pounds; and a cross-over sub for connecting the first drill pipe string to the second drill pipe string.

5. The work string as claimed in claim 4 further comprising at least one joint of heavy-weight drill pipe having a minimum adjusted weight of 13 pounds per foot.

6. The work string as claimed in claim 4 further comprising a drill bit or a mud motor with a drill bit connected to a first joint of the first drill pipe string.

7. A method of completing a cased well bore with a curved section and a long lateral bore, comprising:

running a work string of first high torque drill pipe joints into the cased well bore until a length of the work string of first high torque drill pipe joints equals at least a combined length of the curved section plus a length of the long lateral bore, the work string of first high torque drill pipe joints having a maximum nominal outer diameter of 2.375 inches, a nominal pipe body wall thickness of 0.301", an upset forged on each end of the first drill pipe having a nominal outer diameter of 3.062" and a nominal inner diameter of 1.5", and calculated plain end weight of 6.664 pounds per foot, a connection friction welded to each upset, each connection having a connection outer diameter of 3.062 inches, connection inner diameter of 1.5 inches, a connection torsional strength of at least 9,600 foot-pounds and a connection tensile strength of at least 269,000 pounds, the first high torque drill pipe joints further having an adjusted weight of about 7.63 pounds per foot, and a minimum makeup torque of at least 5,800 foot-pounds;

connecting a cross-over sub to the work string of first high torque drill pipe joints;

adding larger diameter high torque drill pipe joints to the work string until the work string resists further movement into the long lateral well bore, the larger diameter high torque drill pipe joints having a maximum nominal outer diameter of 2.875 inches, a nominal pipe body wall thickness of 0.389 inches, an upset forged on each end of each joint of the larger diameter drill pipe joints having a nominal outer diameter of 3.625 inches and a nominal inner diameter of 2.0 inches, and calculated plain end weight of 10.327 pounds per foot, a connection friction welded to each upset, each connection having a connection outer diameter of 3.625 inches, connection inner diameter of 2.0 inches, a connection torsional strength of at least 14,400 foot-pounds and a connection tensile strength of at least 352,000 pounds, an adjusted weight of about 11.63 pounds per foot, and a minimum makeup torque of 7,800 foot-pounds; and adding at least one of a heavy-weight drill pipe joint and a drill collar to the work string until the work string is pushed to an end of the lateral bore, the heavy-weight drill pipe joints having a maximum nominal outer diameter of 2.875 inches and a minimum adjusted weight of 13 pounds per foot, and the drill collar joints having a same connection diameter as a connection diameter of the larger diameter drill pipe joints and a minimum adjusted weight of 23 pounds per foot.

8. The method as claimed in claim 7 wherein prior to running the work string of high torque drill pipe joints into the well, the method further comprises connecting a drill bit to a first joint of the work string before running the first joint into the well.

9. The method as claimed in claim 8 further comprising rotating the work string using a top drive to drill out any obstructions encountered in the well as the work string is being run into the well.

10. The method as claimed in claim 9 further comprising injecting a chemical treatment into the well after the well is cleared of the obstructions.

* * * * *